United States Patent [19]

Friedli

[11] Patent Number: 4,991,694

[45] Date of Patent: Feb. 12, 1991

[54] GROUP CONTROL FOR ELEVATORS WITH IMMEDIATE ALLOCATION OF DESTINATION CALLS

[75] Inventor: Paul Friedli, Remetschwil, Switzerland

[73] Assignee: Inventio AG, Switzerland

[21] Appl. No.: 401,035

[22] Filed: Aug. 31, 1989

[30] Foreign Application Priority Data

Sep. 1, 1988 [CH] Switzerland ..... 03275/88

[51] Int. Cl.[5] ..... B66B 1/18

[52] U.S. Cl. ..... 187/127

[58] Field of Search ..... 187/127

[56] References Cited

U.S. PATENT DOCUMENTS

| | | | |
|---|---|---|---|
| 4,718,520 | 1/1988 | Schroder | 187/127 |
| 4,784,240 | 11/1988 | MacDonald et al. | 187/127 |
| 4,878,562 | 11/1989 | Schroder | 187/127 |

FOREIGN PATENT DOCUMENTS

| | | |
|---|---|---|
| 0026406 | 4/1981 | European Pat. Off. . |
| 0032213 | 7/1981 | European Pat. Off. . |
| 0050304 | 4/1982 | European Pat. Off. . |
| 0050305 | 4/1982 | European Pat. Off. . |
| 0062141 | 10/1987 | European Pat. Off. . |
| 0246395 | 11/1987 | European Pat. Off. . |
| 0301173 | 2/1989 | European Pat. Off. . |
| 0308590 | 3/1989 | European Pat. Off. . |

*Primary Examiner*—A. D. Pellinen
*Assistant Examiner*—W. E. Duncanson, Jr.
*Attorney, Agent, or Firm*—Marshall & Melhorn

[57] ABSTRACT

An elevator group control assigns a floor call, which is to be assigned to a car for the first time, immediately and finally after its input. The operating costs corresponding to the waiting times of passengers are computed merely for the input floor and the destination floor of the new call from data specific to each of the elevators and these costs are transferred into a cost register for all the elevators immediately after the input of the call. Thereafter, the comparison of these operating costs takes place at once, wherein the call is finally assigned to the elevator with the smallest operating costs. The operating costs computation extends over all traffic participants situated in the cars and at the floors, wherein the computer utilizes a traveling time table, in which the traveling times between each floor and every other floor are stored. The door opening and closing times of the elevator concerned are stored in a door time table, which times the computer utilizes for the computation of the stopping time of the car. By computing the operating costs in this manner, better comparison results are achieved and exact data on the actual waiting times of all traffic participants is available.

5 Claims, 2 Drawing Sheets

GROUP CONTROL FOR ELEVATORS WITH IMMEDIATE ALLOCATION OF DESTINATION CALLS

BACKGROUND OF THE INVENTION

The present invention relates in general to a group control for elevators and, in particular, to a group control for immediately allocating destination calls.

Many known elevator group control systems include call registering devices arranged on the floors, by means of which calls for desired floors of destination can be entered. The entered calls are stored in floor and car call memories assigned to the elevators of the group where a call characterizing the entry floor is stored in the floor call memory and the calls characterizing the destination floors are stored in the car call register memory. Selectors assigned to each elevator of the group indicate the floor of a possible stop. First and second scanners are assigned to each elevator of the group. The first scanner operates during a cost of operation calculation cycle to store for each floor the costs in a cost memory. The second scanner operates during a cost comparison cycle of the costs for all elevators by means of which the entered call is assigned to the car of the elevator group which exhibits the lowest operating costs.

Such a group control is shown in the European patent application No. EP-A 0 246 395 where the assignments of the cars to the entered calls can be optimized in time. The car call memory of an elevator of this group control consists of a first memory containing assigned destination floor calls and additional memories assigned to the floors in which the desired floor calls entered at the respective floors, but not yet assigned to a car, are stored. A device, by means of which the entered calls are assigned to the cars of the elevator group, includes a computer in the form of a microprocessor and a comparator device. The computer calculates at each floor, during a scanning cycle of a first scanner, from at least the distance between the floor and the car position indicated by a selector, the intermediate stops to be expected within this distance and the load in the car, a sum proportional to the time losses of waiting passengers at the floors and in the car. In that case, the current car load is corrected by factors which correspond to the presumable numbers of boarding passengers and alighting passengers at future intermediate stops and which factors are derived from the numbers of boarding passengers and alighting passengers during past operations.

If the first scanners encounter a not yet assigned floor call, then the calls entered at this floor for desired floors of destination, stored in the further memories of the car call memory, are also taken into account. A sum proportional to the new floor calls is therefore determined and a total sum is formed. This total sum, also termed cost of operation, is stored in a cost memory by floor. During a scanning cycle of a second scanner, the operating costs of all elevators are compared with each other by means of the comparator device. An assignment command is stored in an assignment register of the elevator with the lowest operating cost, which command designates that floor to which the respective car is optimally assigned in time.

The scanning of all floors in the upward and downward directions and the calculation of the operating costs for each floor, whether a call is present or not, as well as the scanning of all floors for the purpose of the comparison of the operating costs at least at the floors with new calls, requires a relatively large amount of computing time and storage capacity as well as an expensively structured car call memory. On the other hand, an already assigned call, if it has not yet been transferred to the drive control of the elevator concerned, can be allocated to another elevator by reason of a later calculation and comparison cycle. Also, it is advantageous that operating costs are calculated for floors for which no calls have been entered, so that merely the additional operating costs need be calculated upon the registering of a call.

The operating costs formula, which forms the basis of the assignment procedure described in the above-identified patent specification, apart from the already mentioned factors for the calculation of the probable numbers of boarding and alighting passengers at a future stop, includes a factor of delay time ($t_v$) at an intermediate stop and a factor of traveling time ($m \cdot t_m$) of an elevator, which factors are likewise only approximate average values. In this case, the traveling times of the individual elevators can differ from one another for the same number of floors to be traveled due to unequal operating drives, inaccuracies in the floor distances or, in the case of high performance elevators with a leading selector, the different speeds generated. Thus, the assignment procedure can lead to inaccurate results. The operating costs are moreover ascertained merely over a limited range of the travel path, which is however completely sufficient for the comparison of the elevators one among the other, but supplies no indications of the actual waiting times of all passengers participating in the elevator system traffic at the instant of calculation.

In the European patent No. EP-PS 0 301 173, it was proposed to replace the probable numbers of boarding and alighting passengers by the number actually to be expected as an improvement in the operating costs formula. In this case, a sum is formed from the number of the calls entered at a floor and the number of the calls designating this floor as a travel destination and this sum is stored as load value in a load memory, wherein the load value is taken into account in the computation of the operating costs of the floor concerned. If the load values are not changed in the time between the entry of a new call and the transfer of this call to the drive control of the elevator concerned, then the call assignment can be regarded as optimal.

There is shown in the European patent application No. EP-PA 88 110 006.9 a group control of the above-described type which leaves a call first assigned to a car with that car. Thereby, the identity of the assigned car can be signaled to the waiting passengers on the floors almost immediately after the call is entered. Since it can be assumed as improbable that the load values have changed in the very short time between the call entry and assignment, the assignment is optimal at the instant of assignment, at least with respect to the future car load. However, since the initially and definitively assigned call no longer participates in the optimizing process and further calls could be entered until the transfer of this call to the drive control concerned thereby changing the load values accordingly, the assignment can no longer be regarded as optimal in such a case.

SUMMARY OF THE INVENTION

This invention is concerned with the task of improving the prior art elevator group control in such a manner that the waiting times of the passengers can be determined more accurately and more accurate comparison results for an optimum call allocation can be achieved, as well as requiring less computing time and storage capacity.

This problem is solved by the present invention in which the operating costs are computed merely for the call entry floor and the destination floor of the new call and these costs are transferred into a cost register immediately after the call registration. Thereafter, the comparison of the operating costs stored in the cost registers of all cars takes place at once, wherein the call assignment resulting therefrom is final. The operating costs computation extends over all traffic participants situated in the cars and on the floors. A computer utilizes a traveling time table in which the traveling times between each floor and every other floor are stored and door opening and closing times of the elevators stored in door time table, which times the computer also takes into account during the computation of the stopping time of a car.

The invention includes a microcomputer based control having a call memory, and two call assignment memories together with a cost register, a car position register and a selector register. The registers and memories of the microcomputer are connected to a bus which is also connected to a load table, a door time table and a traveling time table. The memories and the cost register are also connected through a switching circuit to a comparison device for comparing the operating cost of each car when assigning a new call.

When a call is registered at a floor, a call identifying the input floor is transferred into a first memory and a call identifying the destination floor is transferred into a second memory of the call memories of all of the elevators in the group. The load memories of all the elevators are either loaded or corrected wherein the number of calls registered at a floor remains stored separately until the passengers associated with that floor have boarded. The operating costs for the input floor and the destination floor of the new call are computed for all the elevators wherein it is presumed that not only the waiting times of the new passengers, but of all traffic participants of already assigned calls of the elevator concerned would increase through the new stops taking place at the input floor and the destination floor. The costs include data on the door times from the door time table and the traveling times from the traveling time table and the number of passengers already situated in the car is taken from the load table. Upon the determination of the elevator with the lowest operating costs, the input floor call and the destination floor call in the first and second memories respectively are entered into the first and second assignment memories respectively such that stopping can be initiated upon the point of onset of breaking at the floor of the newly assigned call. If the switching circuit detects the input floor of an already assigned call in the direction opposite to the new call, then the switching circuit generates a maximum operating cost value to the comparison device so that the new call can not be assigned to the elevator being checked.

The advantages achieved by the present invention are that the computing time and the storage capacity are reduced by the simplification of the calculation method. Better comparison results of the elevators one among the other are achieved with the improved operating costs formula, wherein the respective assignment of a car to a call is optimal at the instant of the allocation. A further advantage is that data about the actual waiting times of all traffic participants is available to the elevator operator from the computation results.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
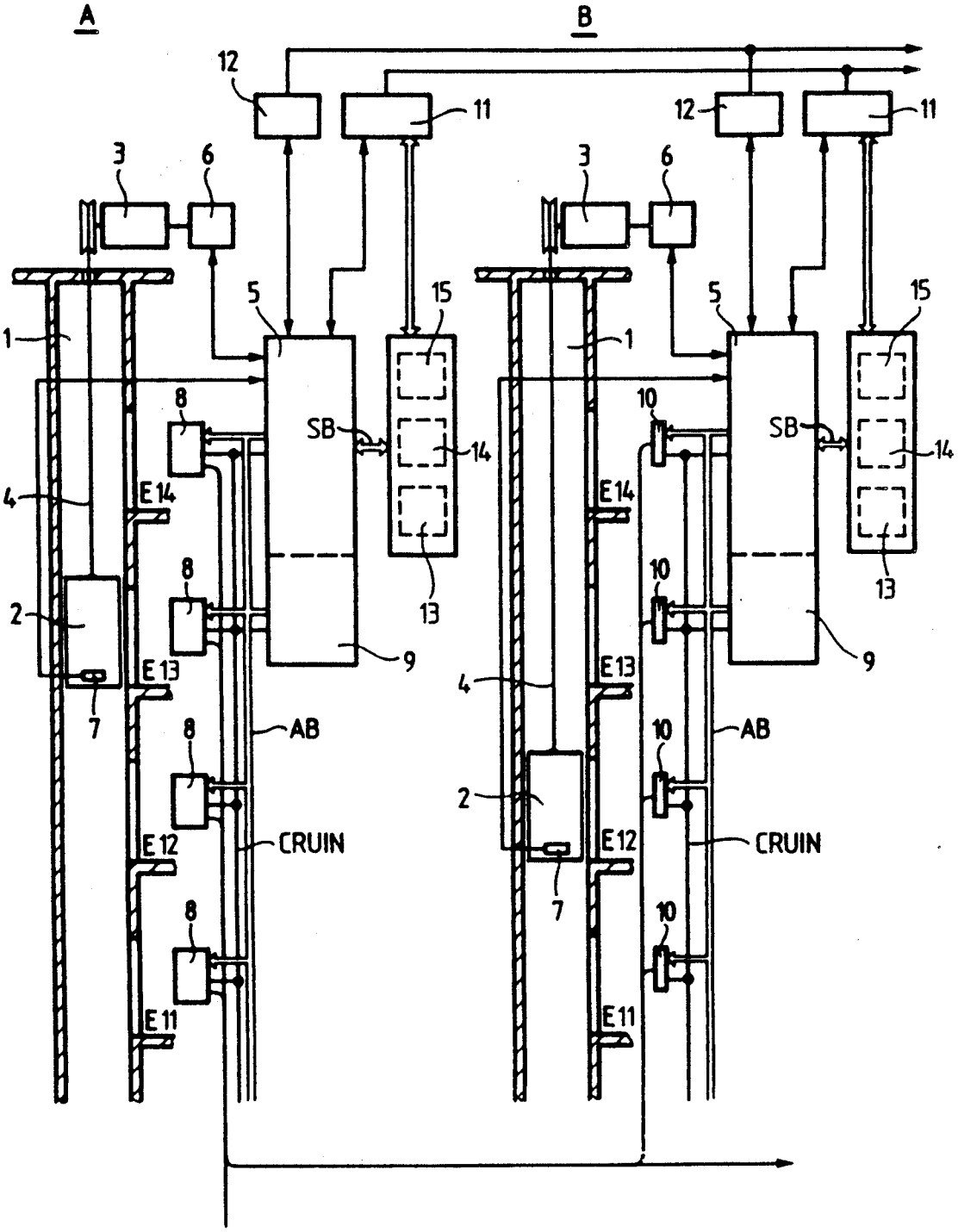
FIG. 1 is a schematic representation of an elevator group control apparatus in accordance with the present invention showing two elevators of the group.

Two elevators of an elevator group are designated by A and B in FIG. 1, wherein each elevator has an elevator car 2 guided in an elevator shaft 1. Each car 2 is driven by a hoist motor 3 by way of a hoist cable 4 to serve fifteen floors E0 to E14 (E0 through E10 not being shown). The hoist motor 3 is controlled by a drive control system, such as is shown in the European patent No. EP-B 0 026 406, where the generation of the nominal or set point values, the control functions and the stop initiation are realized by means of a microcomputer system 5, which is connected with a control unit 6 of the drive control system. The microcomputer system 5 calculates from elevator parameters a sum, corresponding to the average waiting time of all passengers, which forms the basis of the call assignment process. The car 2 includes a load measuring device 7, which is likewise connected with the microcomputer system 5, for determining when passengers enter and leave the elevator car.

Provided at the floors are call registering devices 8, which are for example shown in the European patent application No. EP-A 0 246 395, by means of which floor calls for travel to desired floors of destination can be entered. The call registering devices 8 are in the form of ten key keyboards provided at each of the floors. The call registering devices 8 are connected with the microcomputer system 5 and with an input device 9, shown in the European patent No. EP-B 0 062 141, by way of an address bus AB and a data input conductor CRUIN. The call registering devices 8 can be assigned to more than one elevator of the group. For example, the devices 8 of the elevator A are connected by multiplexers 10 with the microcomputer system 5 and the input device 9 of the elevator B.

The microcomputer systems 5 of the individual elevators of the group are connected together by way of a comparison device 11, shown in the European patent No. EP-B 0 050 304, and by way of a party-line transfer system 12, shown in the European patent No. EP-B 0 050 305, and form, together with the call registering devices 8, the input devices 9, and the components described below, the elevator group control according to the invention. A load table or memory is designated by 13, a door time table is designated by 14 and a traveling time table is designated by 15, all of which are connected with a bus SB of the microcomputer system 5 and explained in more detail below.

Figure 2:
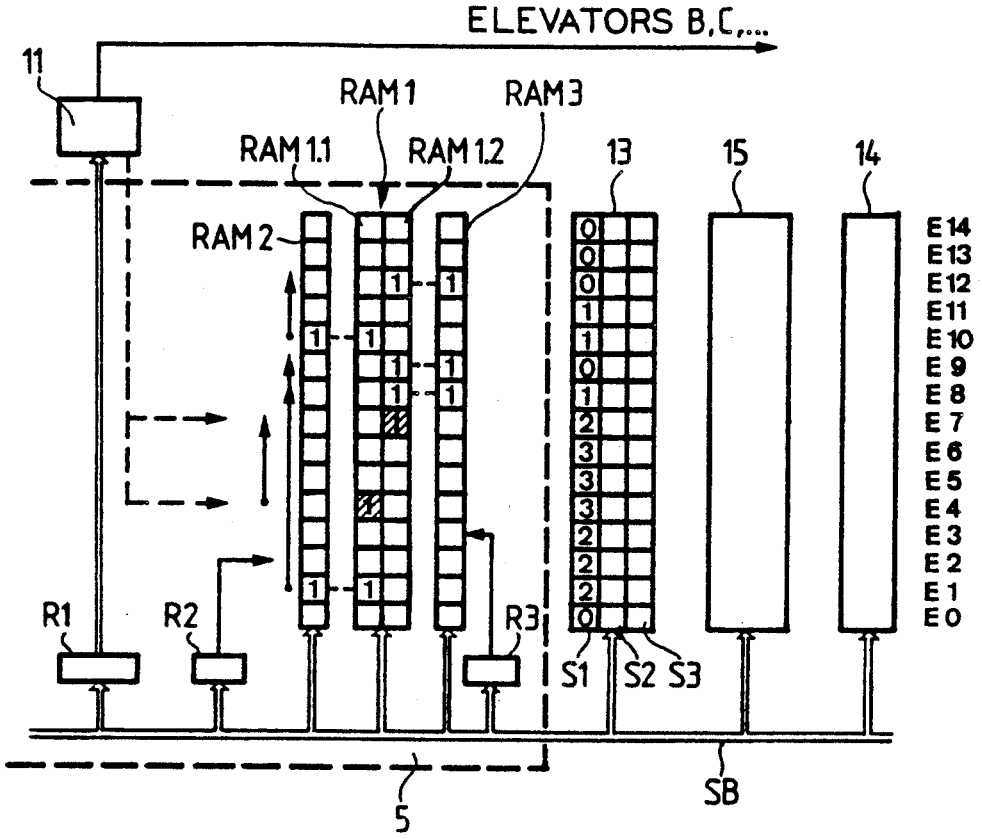
FIG. 2 is block diagram of the computer and memories of the apparatus shown in FIG. 1.

The portion of the microcomputer system 5 associated with the elevator A is illustrated schematically in FIG. 2. A call memory RAM1 and first and second assignment memories RAM2 and RAM3, which for each direction of travel possess storage spaces corresponding to the number of the floors, are shown wherein only the floors associated with the upward travel direction calls are illustrated. The call memory RAM1 consists of first and second memories RAM1.1 and RAM1.2, wherein hall calls designating the respective input floor are stored in the first memory RAM1.1 and the car calls identifying the destination floors are stored in the second memory RAM1.2, and wherein the first assignment memory RAM2 is associated with the first memory RAM1.1 and the second assignment memory RAM3 is associated with the second memory RAM1.2.

A cost register R1 is provided for the storage of the operating costs and a car position register is designated by R2. A selector R3 in the form of a further register generates addresses which correspond to the floor numbers and by means of which the storage places of the memories RAM1.1, RAM1.2, RAM2 and RAM3 can be addressed. While the selector R3 indicates that floor at which the traveling car 2 could still stop, the car position register R2 indicates that floor in the region of which the car 2 is actually situated. The call memory RAM1 as well as the first and the second assignment memories RAM2 and RAM3 are read-write memories which are connected with the bus SB of the microcomputer system 5. The calls, according to the example of FIG. 2, stored in the call memory RAM1 and the assignment instructions stored in the assignment memories RAM2 and RAM3, are characterized symbolically by "1" wherein assigned calls (dashed connecting line) are shown for the floors E1, E8, E9, E10 and E12 and new, not yet assigned calls (hatched fields) are shown for the floors E4 and E7.

According to FIG. 2, the load memory 13 includes a read-write memory in the form of a matrix which has exactly as many rows as floors and three columns S1, S2 and S3. The first column S1 of the matrix is associated with calls in the same direction of travel as and in front of the car 2. The second column S2 is associated with calls in the opposite direction of travel as the car 2. The third column S3 is associated with calls in the same direction of travel as and behind the car 2. Stored in the storage locations of the load memory 13 are load values in the form of a number of persons who are situated in the car 2 on the departure from or travel past an associated floor. For example, it is assumed in FIG. 2 that the car 2 is travelling in an upward direction in the region of the floor E2 (see register R2) and upward calls were entered at the floors E1, E4 and E10.

After the transfer of the calls into the first and second memories RAM1.1 and RAM1.2, a sum is formed from the number of calls (boarding passengers) registered at a floor and the number of calls (alighting passengers) designating this floor as a travel destination and that sum is stored as a load value in the load memory 13. The first column S1 of the load memory 13 will therefore by reason of the chosen number of boarding and alighting passengers display the load values evident from the FIG. 2. Thus, for example, the load value "2" results for the floor E7 from two boarding passengers at the floor E1, one boarding passenger at the floor E4 and one alighting passenger at the floor E7. The computer 5 can, during the computation of the operating costs, retrieve from the load memory 13 the number of passengers situated in the car 2 at any future stop. Beyond that, it can be ascertained by reference to the stored load values whether overloading would occur on assignment of a call for a certain floor to a car 2.

As described in the preceding, conclusions concerning the future boarding and alighting passengers and the loads thereby arising in the car 2 are drawn from the calls registered during the setting up of the load memory 13. It is, however, possible that passengers entered their call more than once or that passengers on board have not entered any call. In these cases, the stored load values must be corrected. For this purpose, the load memory 13 is connected by way of the microcomputer system 5 with the load measuring device 7 of the car 2 (FIG. 1). In the first case, as many of the same destination floor calls are deleted in the memory as correspond to the difference between the stored value and the actually measured car load. Thereafter, all stored values between the boarding floor and the destination floor of the call registered more than once are corrected. In the second case, the stored load values must be increased, for which it is presumed that the passenger who has not entered any call wants to travel to a destination floor which has been identified already by a call entered by another passenger. If several calls have been entered, it is assumed that this passenger wants to travel to the remotest destination floor.

The door time table 14 includes a read-write memory in which are stored the door opening and closing times of the associated elevator car determined in real time by the microcomputer system 5. In this case, it is presumed that the door opening and closing times are subject to certain fluctuations from floor to floor, which fluctuations are measured and can be taken into consideration in the computation of the operating costs. The computer 5 computes the stopping time ($t_h$) of the car for each stop according to the sum of the associated table values of the door opening time ($t_{auf}$), the door closing time ($t_{zu}$) and the time ($t_{off}$) for which the door is kept open in dependence on the number of boarding or alighting passengers.

The traveling time table 15 likewise includes a read-write memory in which the traveling times of the car between each floor and every other floor are stored separately according to upward and downward directions of travel. The traveling time table 15 is set up during the initial installation through learning travels from each floor to every other floor and is complete when all possible travels have been carried out at least once. In this manner, the traveling times, which differ more or less one from the other for the same interruption-free travel path, of the individual elevators of the group are determined. Differences can be due to unequally operating drives, inaccuracies in the floor distances or, in the case of high performance elevators, in the distance-dependent variable limiting speeds.

The computation of the operating costs utilizes the following variables:

F—The number of new passengers at the call input floor;

F'—The number of boarding passengers for already assigned calls between the call input floor and the destination floor;

F''—The number of boarding passengers for already assigned calls beyond the destination floor;

K—Operating costs for the call input floor or the destination floor ($K_{rs}+K_{rz}+K_{ps}+K_{ps}+K_{pz}+K_{ws}+K_{wz}$);

$K_{max}$—The maximum value of the operating cost;

$K_{ps}$—The loss of time of the passengers in the car for an intermediate stop at the call input floor ($\Delta t_s \cdot P_s$);

$K_{pz}$—The loss of time of the passengers in the car for an intermediate stop at the destination floor ($\Delta t_z \cdot P_z$);

$K_{rs}$—The waiting time of the new passengers at the call input floor ($t_s \cdot F$);

$K_{rz}$—The traveling time of the new passengers ($t_z \cdot F$);

$K_{ws}$—The waiting time of all boarding passengers between the call input floor and the destination floor ($\Delta t_s \cdot F'$);

$K_{wz}$—The waiting time of all boarding passengers beyond the destination floor ($(\Delta t_s+\Delta t_z) \cdot F''$);

$P_s$—The number of passengers at the call input floor;

$P_z$—The number of passengers at the destination floor;

$t_{auf}$—The door opening time;

$t_h$—The stopping time of a car at a floor ($t_{auf}+t_{off}+t_{zu}$);

$t_{hs}$—The stopping time at the call input floor "s";

$t_{hz}$—The stopping time at the destination floor "z";

$t_{off}$—The time the door is open for the number of boarding and alighting passengers at a constant time factor per person;

$t'_{off}$—The time for which the door is open at the call input floor of the new call due to the number of new boarding passengers at a constant time factor per person;

$t''_{off}$—The time for which the door is open at the destination floor of the new call due to the number of new alighting passengers at a constant time factor per person.

$t_s$—The traveling time of the car to the call input floor (plus delay due to intermediate stops);

$\Delta t_s$—The loss of time per passenger due to the stopping time ($t_h$) at the call input floor intermediate stop and the traveling time difference which results from the travel with an intermediate stop and the travel without an intermediate stop ($t_{xs}+t_{hs}+t_{sy}-t_{xy}$);

$t_{sy}$—The traveling time from the call input floor "s" to a floor "y";

$t_z$—The traveling time of the car from the call input floor to the destination floor (plus delays due to the intermediate stops);

$\Delta t_z$—The loss of time per passenger due to the stopping time ($t_h$) at the destination floor intermediate stop and the traveling time difference which results from the travel with the intermediate stop and the travel without the intermediate stop ($t_{xz}+t_{hz}+t_{zy}-t_{xy}$);

$t_{zu}$—The door closing time;

$t_{xs}$—The travelling time from a floor "x" to the call input floor "s" of the new call;

$t_{xy}$—The traveling time from the floor "x" to the floor "y" without a stop at the call input floor "s";

$t_{xz}$—The traveling time from the floor "x" to the destination floor "z" of the new call;

$t_{zy}$—The traveling time from the destination floor "z" to the floor "y".

In the computation of the operating costs according to the relationship $K=K_{rs}+K_{rz}+K_{ps}+K_{pz}+K_{ws}+K_{wz}$, the table values associated with the travel paths concerned can be used directly. The table values also find use in order to compute the losses in time $\Delta t_s$ and $\Delta t_z$, caused by a new call, of traffic participants associated with already assigned calls. In this case, the loss of time $\Delta t_s$ or $\Delta t_z$ of the passengers situated in the car during the intermediate stop caused by a new call is dependent on the stopping time $t_h$ and the difference which results from the traveling times with the intermediate stop and the traveling time without the intermediate stop. The loss of time $\Delta t_s$, which is caused by an intermediate stop at the input floor of a new call, must be taken into consideration during the computation of the waiting time of all boarding passengers of already assigned calls between the input floor and the destination floor. For the boarding passengers of already assigned calls beyond the call input floor and the destination floor of the new call, the loss of time $\Delta t_z$, which arises on an intermediate stop at the destination floor, must be taken into account.

If a stop caused by an already assigned call coincides with a stop caused by a new call at the input floor or destination floor, then the loss of time $\Delta t$ is reduced to the stopping time $t_z$, since the stop has not been forced by a new call, but occurs in any case. The stopping time $t_h$ in this case consists merely of the time $t'_{off}$ or $t''_{off}$, for which the door is kept open and which is calculated according to the relationships defined above from the number of boarding or alighting passengers for the new call.

Figure 3:
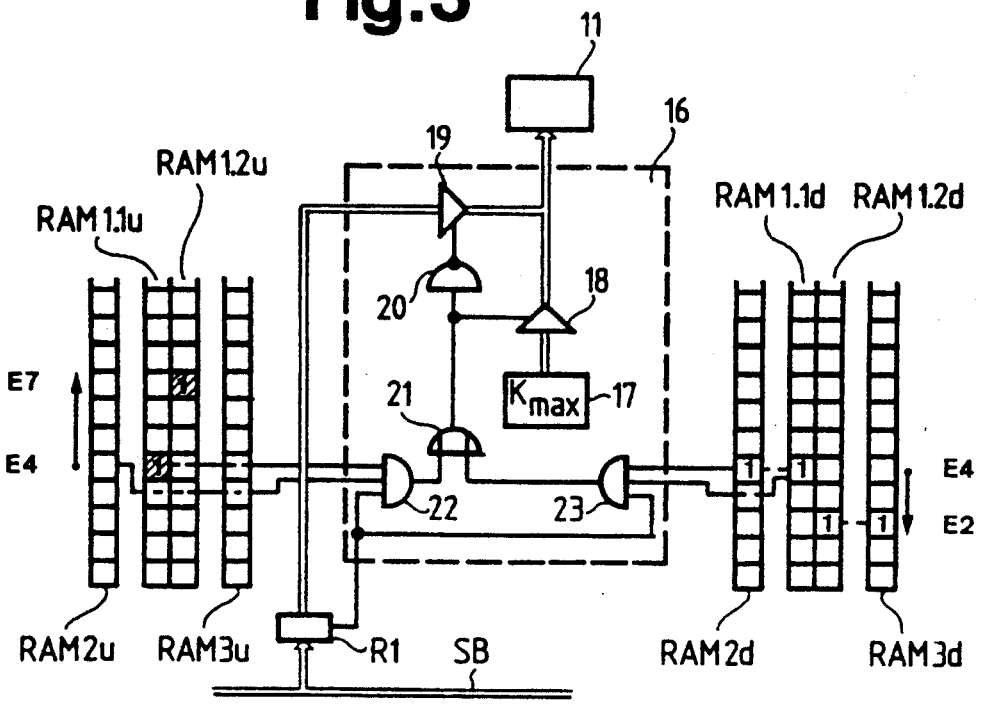
FIG. 3 is a combined block diagram and schematic representation of the memories and switching circuit of the apparatus shown in FIG. 1.

In the FIG. 3, the first and the second memories RAM1.1 and RAM1.2 respectively of the call memory RAM1, as well as the first and the second call assignment memories RAM2 and RAM3, are designated additionally by "u" for the upward calls and by "d" for the downward calls. A switching circuit 16, which connects the storage cells of the upward and downward memories, has the task of suppressing the assignment of a new call when a call of opposite direction has already been assigned for the same input floor for the associated elevator. In this manner, the boarding passengers for the new call are prevented from riding in the wrong direction.

According to FIG. 3, the switching circuit 16 includes a register 17 containing a maximum value $K_{max}$ of the operating costs K, first and second tristate buffers 18 and 19, a NOT or NAND gate 20, an OR gate 21 having two inputs, and a first and a second AND gate 22 and 23, each having three inputs. The first AND gate 22 has one input connected to the outputs of the upward direction storage cells of the first memory RAM1.1u, another input connected to the upward direction storage cells of the first assignment memory RAM2u, and a third input connected to an output of the cost register R1. The second AND gate 23 has an input connected to the downward direction storage cells of the first memory RAM1.1d, another input connected to the downward direction storage cells of the first assignment memory RAM2d, and a third input connected to the output of the cost register R1. The outputs of the AND gates 22 and 23 are connected to the inputs of the OR gate 21. An output of the OR gate 21 is connected to the activating input of the first tristate buffers 18 and through the NOT gate 20 to the activating input of the second tristate buffers 19. The outputs of the register 17 are connected through the first tristate buffers 18 to the data inputs of the comparison device 11, which inputs are also connected through the second tristate buffers 19 to the outputs of the cost register R1. The switching circuit 16, which is for example formed by a program in the microcomputer system 5, is activated each time there is a transfer of the operating costs K into the cost register R1 for the associated floor.

The elevator group control described above operates as follows: After the input of a call, for example input at the floor E4 for the floor E7 according to FIG. 2, a call identifying the input floor is transferred into the first memory RAM1.1 and a call identifying the destination floor is transferred into the second memory RAM1.2 of the call memories RAM1 of all the elevators. Thereafter, as already described in the preceding, the load memories 13 of all of the elevators are loaded, or corrected in the case of already present load values, wherein the number of the calls registered at a floor remains stored separately until the passengers concerned have boarded. A test is made for each elevator whether the load value for the floor to be assigned would exceed a certain load limit. If so, as described in the European patent specification No. EP-PS 0 301 173, the elevator concerned is excluded from the allocation procedure. Thereafter, the operating costs K for the input floor and the destination floor of the new call are computed for all elevators according to the relationships set forth above. In this case, it is presumed that not only waiting times of the new passengers, but of all traffic participants of already assigned calls of the associated elevator, would increase due to the new stops possibly taking place at the call input floor and the destination floor.

As mentioned above, the computer 5 reads the door times from the door time table 14 and the travelling times from the traveling time table 15, wherein for the latter the floor indicated by the car position register R2 is decisive. The number of the passengers already situated in the car is read from the load memory 13. The number of separately stored calls is used for the number of boarding passengers waiting at the floors. Thus, according to the example of FIG. 2, the traveling time $t_s$ from the floor E2 to the floor E4 and the number $F=1$ of new passengers is taken into account for the call costs $K_{rs}$ in the case of the elevator A. The loss of time $\Delta t_s$, caused by the intermediate stop at the floor E4, for the two passengers from the floor E1 is taken into consideration according to the calculation $K_{ps}$. In the determination of the waiting costs $K_{wz}$, finally, the losses of time $\Delta t_s$ and $\Delta t_z$, which are caused by the intermediate stops at the floors E4 and E7, and the number $F''=1$ of the boarding passengers from the floor E10 are taken into consideration.

Immediately after the computation, the operating costs K are transferred into the cost register R1 and compared by means of the comparison device 11, for example proposed according to European patent No. EP-B 0 050 304, with the operating costs K of the other elevators. It may be assumed that the elevator A displays the lowest operating cost K so that an assignment instruction is entered (dashed arrows, FIG. 2) in the first assignment memory RAM2 at the floor E4 and in the second assignment memory RAM3 at the floor E7. The entry of the assignment instruction into the second assignment memory RAM3 can, for example, be achieved whereby the address of the destination floor apart from the selection code displays an address portion identifying the input floor, Thus, all destination calls always have addresses which include an address portion identifying the commonly assigned input floor. If the selector R3 now switches to the newly assigned floor E4, in continuation of the assumed upward travel of the car 2 disposed, for example, in the region of the floor E2, then stopping can be initiated upon reaching the point of onset of braking according to the drive control shown in the European patent No. EP-B 0 026 406.

When the input floor of an already assigned call in the opposite direction of travel from the car is selected, for example the call at the input floor E4, then the output of the second AND gate 23 of the switching circuit 16 (FIG. 3) is set high on the transfer of the operating costs K into the cost register R1 so that the first tristate buffers 18 are activated and the second tristate buffers 19 are blocked. Thereby, not the operating costs K disposed in the cost register R1, but the maximum value $K_{max}$ contained in the register 17 is fed to the comparison device 11 so that the new call from the floor E4 cannot be assigned to the elevator A in this case.

After the assignment of the call to the elevator A, as initially assumed according to the example, the cost registers R1 of all the elevators are erased and are ready for the reception of the operating costs K of a further new call. If it is ascertained during the assignment procedure of a new call from the same floor that the elevator A does not display the smallest operating costs K, then the assignment instructions which have been entered into the first and the second assignment memories RAM2 and RAM3 of the elevator A, can be erased, which can for example be achieved by means of a device shown in the European patent application No. EP-PA 88 110 006.9.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An improvement in a group control for elevators having at least two elevator cars for serving a plurality of floors and for the immediate assignment of floor calls of destination, the group control including call registering devices arranged at the floors for entering floor calls for desired floors of destination, a call memory connected to said call registering devices and including a first memory and a second memory where on input of floor calls at a floor, an input floor call representing the entry floor is stored in the first memory and a destination floor call representing the floor of destination is stored in the second memory, load measuring devices provided in the cars, a load table connected to said load measuring devices for storing a number of passengers in the cars, selectors associated with each elevator of the group for indicating in each case the floor of a possible stop, and means for assigning the entered floor calls to the elevators of the elevator group including a computer and comparison device for each elevator wherein the computer calculates at each floor designated by the selector operating costs corresponding to the waiting times of passengers from data specific to the elevator, and wherein at least one assignment memory is provided and the operating costs of all elevators are compared with each other by means of the comparison device and a new floor call is assigned by the entry of an assignment instruction into the assignment memory of the elevator which displays the lowest operating costs, the improvement comprising:

a cost register for each car connected to the associated computer and the associated comparison device for storing the operating costs for a floor call input floor and the destination floor immediately after the entry of said floor call;

a door time table for each car connected to the associated computer for storing door opening and closing times which are utilized by the computer in the calculation of the stopping time of the car for the operating costs, wherein said stopping time of each elevator car is calculated by said associated computer by adding the door opening time to the time for which the door is kept open based on the number of the boarding and alighting passengers times a constant time factor per person plus the door closing time;

a travelling time table for each car connected to the associated computer for storing travelling times between each floor and each other floor in accordance with upward and downward directions of travel, the computer also utilizing said travelling times in the calculation of the operating costs; and a car position register for each car connected to the associated computer for storing the instantaneous position of the car which the computer utilizes as the basis for access to said travelling time table.

2. The improvement according to claim 1 wherein each said computer calculates the loss of time of a passenger in the associated car due to a stop caused by said floor call as the loss of time resulting from an intermediate stop at the associated input floor plus the loss of time due to an intermediate stop at the associated destination floor.

3. The improvement according to claim 2 wherein each said computer calculates said loss of time upon coincidence of a stop at said floor call and an allocated call as the time for which the door is kept open at the input floor of said floor call due to the number of new boarding passengers times a constant time factor and the time for which the door is kept open at the destination floor due to the number of new alighting passengers times said constant time factor.

4. The improvement according to claim 1 wherein said first memory of said call memory stores calls identifying the input floor and said second memory of said call memory stores calls identifying the destination floor, and wherein a first assignment memory is connected said first memory and a second assignment memory is connected to said second memory for storing the assignment instructions.

5. The improvement according to claim 4 including a switching circuit having a maximum cost register for storing a maximum operating cost value; a first AND gate having one input connected to upward direction storage cells of said first memory, a second input connected to upward direction storage cells of said first assignment memory, and a third input connected to an enable output of said cost register; a second AND gate having a first input connected to downward direction storage cells of said first memory, a second input connected to downward direction storage cells of said first assignment memory and a third input connected to said enable output of said cost register; an OR gate having inputs connected to outputs of said first and second AND gates; a first tristate buffer having an input connected to an output of said maximum cost register, an output connected to an input of the comparison device, and an activating input connected to an output of said OR gate; a NOT gate having an input connected to said output of said OR gate; and a second tristate buffer having an input connected to a data output of said cost register, an output connected to said input of the comparison device, and an activating input connected to an output of said NOT gate, and wherein said switching circuit is activated from said enable output upon the transfer of the operating costs into said cost register and, upon the detection of the presence of an already allocated call in a direction opposite to said floor call at the input floor by one of said first and second AND gates, the operating costs are blocked by said second tristate buffer and the maximum cost value stored in said maximum cost register is transferred to the comparison device by said first tristate buffer to prevent said floor call from being assigned to the associated elevator car.

* * * * *

UNITED STATES PATENT AND TRADEMARK OFFICE

CERTIFICATE OF CORRECTION

PATENT NO. : 4,991,694

DATED : February 12, 1991

INVENTOR(S) : Paul Friedli

It is certified that error appears in the above-identified patent and that said Letters Patent is hereby corrected as shown below:

In column 10, lines 35-68 and column 11, lines 1-21, replace claim 1 as follows:

1. An improvement in a group control for elevators having at least two elevator cars for serving a plurality of floors and for the immediate assignment of floor calls of destination, the group control including call registering devices arranged at the floors for entering floor calls for desired floors of destination, a call memory connected to said call registering devices and including a first memory and a second memory where on input of floor calls at a floor, an input floor call representing the entry floor is stored in the first memory and a destination floor call representing the floor of destination is stored in the second memory, load measuring devices provided in the cars, a load table connected to said load measuring devices for storing a number of passengers in the cars, selectors associated with each elevator of the group for indicating in each case the floor of a possible stop, and means for assigning the entered floor calls to the elevators of the elevator group including a computer and comparison device for each elevator wherein the computer calculates operating costs corresponding to the waiting times of passengers from data specific to the elevator, and wherein at least one assignment memory is provided and the operating costs of all elevators are compared with each other by means of the comparison device and a new floor call is assigned by the entry of an assignment instruction into the assignment memory of the elevator which displays the lowest operating costs, the improvement comprising:

a cost register for each car connected to the associated computer and the associated comparison device for storing the operating costs for a floor call input floor and the destination It is certified that error appears in the above-identified patent and that said Letters Patent is hereby corrected as shown below:

floor immediately after the calculation of the operating costs by the computer and wherein the comparison device compares the operating costs in said cost register of all elevators immediately after the transfer of the operating costs to said cost register and the assignment of the floor call is final;

a door time table for each car connected to the associated computer for storing door opening and closing times which are utilized by the computer in the calculation of the stopping time of the car for the operating costs, wherein said stopping time of each elevator car is calculated by said associated computer by adding the door opening time to the time for which the door is kept open based on the number of the boarding and alighting passengers times a constant time factor per person plus the door closing time;

a travelling time table for each car connected to the associated computer for storing travelling times between each floor and each other floor in accordance with upward and downward directions of travel, the computer also utilizing said travelling times in the calculation of the operating costs; and a car position register for each car connected to the associated computer for storing the instantaneous position of the car which the computer utilizes as the basis for access to said travelling time table.

UNITED STATES PATENT AND TRADEMARK OFFICE

CERTIFICATE OF CORRECTION

PATENT NO. : 4,991,694

DATED : February 12, 1991

INVENTOR(S) : Paul Friedli

It is certified that error appears in the above-identified patent and that said Letters Patent is hereby corrected as shown below:

Column 12, after line 40, add claims 7 and 8 as follows:

7. An improvement in a group control for elevators having at least two elevator cars for serving a plurality of floors and for the immediate assignment of floor calls of destination, the group control including call registering devices arranged at the floors for entering floor calls for desired floors of destination, a call memory connected to said call registering devices and including a first memory and a second memory where on input of floor calls at a floor, an input floor call representing the entry floor is stored in the first memory and a destination floor call representing the floor of destination is stored in the second memory, load measuring devices provided in the cars, a load table connected to said load measuring devices for storing a number of passengers in the cars, selectors associated with each elevator of the group for indicating in each case the floor of a possible stop, and means for assigning the entered floor calls to the elevators of the elevator group including a computer and comparison device for each elevator wherein the computer calculates operating costs corresponding to the waiting times of passengers from data specific to the elevator, and wherein at least one assignment memory is provided and the operating costs of all elevators are compared with each other by means of the comparison device and a new floor call is assigned by the entry of an assignment instruction into the assignment memory of the elevator which displays the lowest operating costs, the improvement comprising:

a cost register for each car connected to the associated computer and the associated comparison device for storing the operating costs (K), the computer calculating the operating costs according to a predetermined relationship ($K = K_{rs} + K_{rz} + K_{ps} + K_{pz}$ It is certified that error appears in the above-identified patent and that said Letters Patent is hereby corrected as shown below:

$+ K_{ws} + K_{wz}$) for only a floor call input floor and a destination floor immediately after the floor call input and wherein the operating costs are transferred immediately after calculation to said cost registers and the comparator device compares the operating costs in said cost registers of all the elevators immediately after the transfer and a resulting floor call assignment is final;

a door time table for each car connected to the associated computer for storing door opening and closing times which are utilized by the computer in the calculation of the stopping time of the car for the operating costs;

a traveling time table for each car connected to the associated computer for storing traveling times between each floor and each other floor in accordance with upward and downward directions of travel, the computer also utilizing said traveling times in the calculation of the operating costs; and a car position register for each car connected to the associated computer for storing the instantaneous position of the car which the computer utilizes as the basis for access to said traveling time table.

UNITED STATES PATENT AND TRADEMARK OFFICE

CERTIFICATE OF CORRECTION

PATENT NO. : 4,991,694

DATED : February 12, 1991

INVENTOR(S) : Paul Friedli

It is certified that error appears in the above-identified patent and that said Letters Patent is hereby corrected as shown below:

8. The improvement according to claim 7 wherein each said computer calculates the loss of time of a passenger in the associated car due to a stop caused by said floor call according to the relationships $\triangle t_s = t_{xs} + t_{hs} + t_{sy} - t_{xy}$ and $\triangle t_z = t_{xz} + t_{hz} + t_{zy} - t_{xy}$.

Signed and Sealed this

Twenty-fifth Day of August, 1992

*Attest:*

DOUGLAS B. COMER

*Attesting Officer*

*Acting Commissioner of Patents and Trademarks*